United States Patent [19]

Strouse

[11] 4,265,387

[45] May 5, 1981

[54] APPARATUS FOR INSTALLING SHINGLES ONTO A ROOF

[76] Inventor: Earl Strouse, 16026 N. 67th Ave., Peoria, Ariz. 85345

[21] Appl. No.: 97,243

[22] Filed: Nov. 26, 1979

[51] Int. Cl.[3] ..... B27F 7/00

[52] U.S. Cl. ..... 227/7; 227/111

[58] Field of Search ..... 227/5, 6, 7, 19, 111, 227/39, 113, 110

[56] References Cited

U.S. PATENT DOCUMENTS

| | | | |
|---|---|---|---|
| 2,915,754 | 12/1959 | Wandel | 227/5 |
| 3,298,584 | 7/1967 | Miller | 227/113 |
| 3,796,365 | 3/1974 | Downing | 227/111 |
| 3,935,983 | 2/1976 | Buttriss | 227/110 |
| 3,972,462 | 8/1976 | Evans et al. | 227/111 |
| 3,984,040 | 10/1976 | Fry | 227/7 |
| 4,036,422 | 7/1977 | Harvey | 227/110 |
| 4,053,093 | 10/1977 | Thueringer | 227/5 |
| 4,084,738 | 4/1978 | Schneider | 227/7 |

*Primary Examiner*—Paul A. Bell

*Attorney, Agent, or Firm*—Norman B. Rainer

[57] ABSTRACT

An apparatus is provided for operation on a roof surface to facilitate accurate rapid placement and fastening of shingles while enabling the operator of the apparatus to remain in substantially upright posture. The apparatus carries a supply of shingles, and provides a guide which delivers each shingle to its proper position. A fastener device carried by the apparatus automatically applies fasteners to said shingles at predetermined intervals.

5 Claims, 6 Drawing Figures

APPARATUS FOR INSTALLING SHINGLES ONTO A ROOF

BACKGROUND OF THE INVENTION

This invention relates to an apparatus to be used by a workman for applying shingles to a roof in a reasonably automatic and precise manner while enabling the workman to maintain a standing position.

The task of applying shingles to a roof generally requires that the workman spend tiresome periods on his knees. The shingles must be precisely positioned and carefully fastened in place with minimum handling of the fragile shingles. Proper application of the shingles is particularly complicated by the fact that the work must be done on an inclined surface which may cause the worker to lose proper perspective of correct alignment patterns. Because the task is difficult, particularly in inclement weather, and tiresome, expedients have been sought which will minimize the time and effort involved while improving the precision of the job and comfort the worker. Such prior efforts have not however been entirely successful.

It is accordingly an object of this invention to provide an apparatus which will facilitate the accurate placement and fastening of shingles on an inclined roof.

It is a further object of this invention to provide an apparatus of the aforementioned nature capable of enabling a worker to administer to the needs of the apparatus in an upright position.

These objects and other objects and advantages of the invention will be apparent from the following description.

SUMMARY OF THE INVENTION

The above and other beneficial objects and advantages are accomplished in accordance with the present invention by the provision of a cart-like apparatus comprised of a rigid framework supported by two front wheels and two paired rear wheels mounted on a pivoted axle, a pair of guide handles disposed above said rear wheels, a material storage compartment positioned generally atop the apparatus, a fastening means such as a stapler adapted to undergo vertical movement within said framework, a conduit guide to direct shingles downwardly into proper position, and means associated with one of said front wheels to activate said fastening means at spaced intervals of traversal of said apparatus along a roof.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
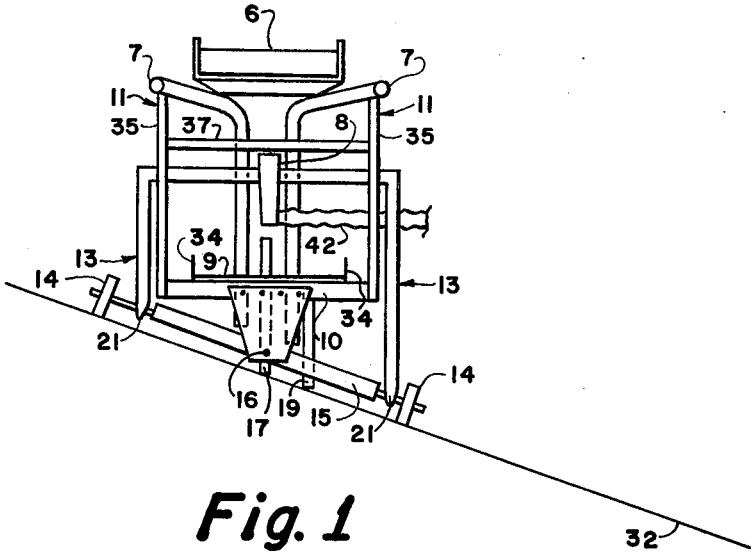
FIG. 1 is a rear view of an embodiment of the apparatus of this invention positioned on an inclined roof.

Referring to FIG. 1, the apparatus of this invention is shown positioned on a roof 32 in a manner whereby the two opposed rear wheels 14, comprised of resilient material, conform to and engage with said roof by virtue of their attachment to axle 15 mounted on pivot 16 pendant from horizontal brace member 10 of frame 11. Said frame is comprised essentially of a pair of tubular metal structural members bent or otherwise shaped so as to form rear upright sections 35, front upright sections 36, shown more clearly in FIG. 2, and upper spanning sections 39 shown in FIG. 3 maintained in spaced apart juxtaposition by upper horizontal brace 37 and lower horizontal brace 10 extending between rear upright sections 35. Upper spanning sections 39 are symmetrically disposed about a vertical plane and possess a generally convergent interrelationship going from rear upright sections 35 to front upright sections 36. As will hereinafter be shown, one side of said frame may be considered the uphill side, and the opposite side the downhill side.

Figure 3:
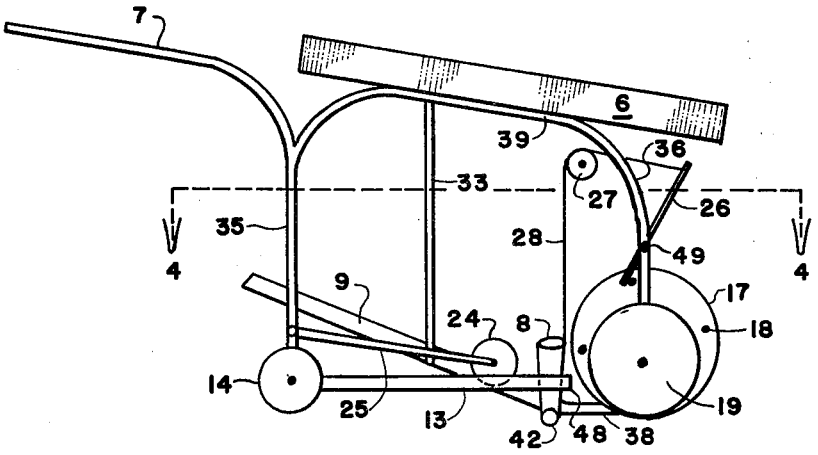
FIG. 3 is a side view of the embodiment of FIG. 1 on level ground with the fastening means in the down position.

A storage compartment 6 designed primarily to hold shingles is mounted atop frame 11 between opposed handles 7 associated with rear upright sections 35. The rearward end of compartment 6 is preferably open, and said compartment is preferably angled downwardly in going from the rear to the front of frame 11. A conduit guide 9 is positioned adjacent the lower region of frame 11, the rearward extremity of said guide being supported from beneath by attachment to lower brace 10 above axle 15, the forward extremity 38 of said guide being adjustably disposed at a level below its rearward extremity and adjacent front wheels 17 and 19. Guide 9 is further supported at the sides 34 thereof by attachment to vertical struts 33 pendant from spanning sections 39, as shown in FIG. 3.

Figure 2:
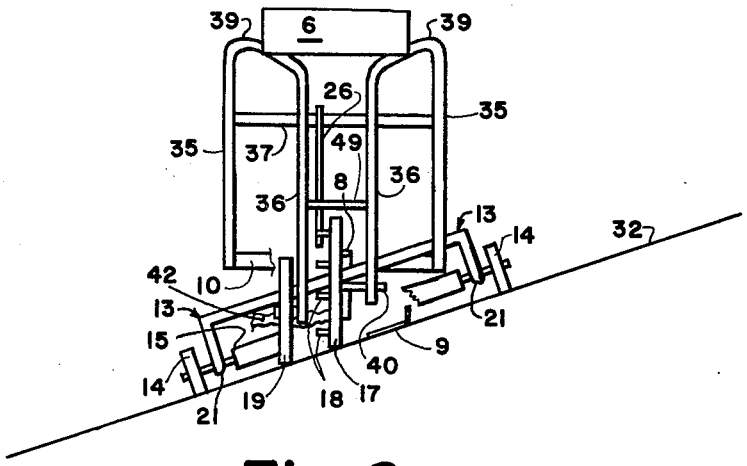
FIG. 2 is a front view of the embodiment of FIG. 1 with the fastening means in the down position.
Figure 6:
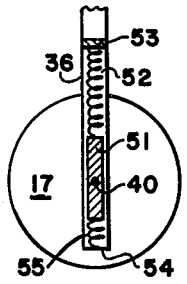
FIG. 6 is a sectional view taken along the line 6—6 of FIG. 4.

As shown most clearly in FIG. 2, a stabilizing wheel 19 is mounted adjacent the lowermost extremity of front upright sections 36, the plane of rotation of wheel 19 being substantially vertical and perpendicular to axle 15. The periphery of stabilizing wheel 19 is preferably provided with a resilient material which secures good frictional contact with roof 32. An activator wheel 17 is mounted in opposed parallel relationship with stabilizing wheel 19 and provided with a series of equidistantly spaced perpendicularly extending pins 18. As shown in FIG. 6, the axle 40 of wheel 17 is perpendicularly joined to slide rod 51 vertically disposed within the hollow interior of one of the front upright sections 36. An upper spring 52 extends between the top of slide rod 51 and stopping plug 53. A lower spring 55 extends between the bottom of slide rod 51 and the bottom 54 of upright section 36. An elongated vertically disposed guide channel, not shown, in the wall of upright section 36 permits movement of slide rod 51. By virtue of this manner of mounting, the elevation of axle 40 can accommodate to the incline of the roof and thereby cause wheel 17 to be "uphill" from stabilizer wheel 19.

An automatic fastening means such as staple gun 8 of conventional design powered by compressed air line 42 is mounted adjacent the center of cross bar 48 of U-shaped bracket 13 whose open extremities 21 are pivotably mounted to axle 15. A lifting arm 26 is attached to axle 49 pivotably supported by front upright sections 36 above activator wheel 17. The lowermost portion of arm 26 is adapted to be displaceably contacted by the pins 18 of wheel 17. The uppermost extremity of arm 26 secures an end of cable 28 which travels over pulley wheel 27 and thence downwardly to engagement with staple gun 8.

Optionally utilized paired rollers 24 held by L-shaped lever 25 pivotably attached to one of the rear upright sections 35, are positioned adjacent the forward end of guide 9 so as to bring stabilizing pressure to bear upon shingles emerging from said guide.

Figure 5:
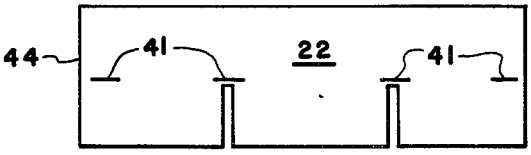
FIG. 5 is a plan view of a shingle showing the placement of fasteners.

In the operation of the apparatus of this invention, the initial shingle of an intended row is carefully set in place manually. The apparatus is then positioned with the front end facing the initial shingle and the rear wheel 14 of the "downhill" side of the apparatus lined up with the downward edge of the previous row of shingles. A shingle is removed from box 6 and inserted into guide 9 whereby it slides downwardly into abutment with the trailing edge 44 of the preceeding shingle. The apparatus is then slowly pulled rearwardly by handles 7. As activator wheel 17 rotates along the surface of the roof, one of the pins 18 displaces the lowermost extremity of lifting arm 26, causing staple gun 8 to be raised. Continued rotation of wheel 17 causes pin 18 to release arm 26, thereby enabling staple gun 8 to fall. In falling, the staple gun automatically fires a staple into the underlying shingle, thereby binding it to the roof. The spacing of pins 18 is such as to cause staples 41 to enter shingles 22 in a predetermined pattern, as shown in FIG. 5. At the completion of a row of shingles, the worker, using handles 7, causes the weight of the apparatus to bear on either stabilizer wheel 19 or rear wheels 14, thereby permitting movement of the apparatus to the site of the next successive row of shingles.

Figure 4:
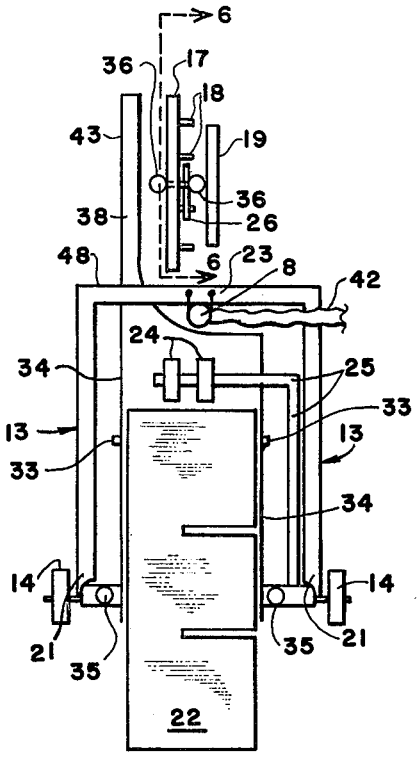
FIG. 4 is an enlarged sectional view taken along the line 4—4 of FIG. 3.

Although a specific embodiment of the invention has hereinabove been exemplified, it is to be understood that alternate equivalent features may be substituted within the purview of the scope of this invention. For example, the frame structure 11 may be of any suitable rigid design which facilitates access to the interior region of the apparatus and provides for the functional attachment of the various components. The handles 7 may be attached to any portion of frame 11 and dimensioned in a manner to afford the workman ease in controlling the positioning of the apparatus and suitable leverage for tilting the apparatus to rest substantially on wheels 19 or 14. The specific configuration of guide 9 is such as to accurately deliver shingles downwardly into abutment with the preceding shingle. In some embodiments, the forward extremity of guide 9 may have an extending arm 43 on the uphill side thereof, as shown in FIG. 4, and suitable positioning means for said arm may be provided in association with frame 11. Such modifications of guide 9 are intended to provide alignment on roofs of different slopes.

The rollers 24 may be replaced by a stationary flat spring or other means which cause the shingle emerging from guide 9 to lay flat upon the roof.

The fastener means may be an automatic device powered by pneumatic pressure or electricity that drives a fastener downwardly with sufficient force to penetrate the shingle and underlying roof structure. Said fasteners may be staples, nails or equivalents thereto. In general, the gravity assisted downward motion of the fastener means will be adequate to cause it to forcefully eject a fastener. However, spring and counterweight devices may be associated with said fastener means in cooperation with the frame structure to expedite the mode of upward or downward motion of the fastener means.

The function of activator wheel 17 is to cause appropriate triggering of the fastener means in response to the linear distance of movement of the apparatus. Accordingly, equivalent means other than pins 18 and associated lifting arm 26 and cable 28 may be utilized to achieve the same function.

When using the apparatus of this invention on an extremely steeply sloped roof, a straight upraised buttressing strip such as a length of 2"×4" lumber may be temporarily attached to the roof along the line that downhill wheel 14 would travel. Such buttressing strip serves the dual function of preventing downward sliding movement of the apparatus and providing a guide for straight horizontal traversal of the roof.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A cart-like apparatus for applying shingles to a roof comprising:

(a) a rigid framework having front, rear and upper portions and uphill and downhill side portions, (b) a pair of rear wheels positioned at opposite extremities of an axle pivotably mounted adjacent its center to the lower rear portion of said framework, said axle being disposed substantially perpendicularly to said side portions, (c) a storage compartment positioned adjacent the upper portion of said framework and adapted to hold flexible roofing shingles, (d) handle means associated with said framework and disposed substanially above said rear wheels, (e) a conduit guide adapted to receive and direct said shingles downwardly into proper position on a roof, (f) a stabilizer wheel mounted adjacent the lower front portion of said framework, the plane of rotation of said wheel being substantially perpendicular to said pivotably mounted axle, (g) an activator wheel positioned in opposed relationship to said stabilizer wheel, mounted so as to have a vertically adjustable axis of rotation, and adapted to roll upon a roof in non-slipping engagement therewith, (h) spaced control means associated with said activator wheel and (i) automatic fastener means associated with said framework in a manner adapted to undergo repetitive lifting and falling movement in response to said spaced control means, whereby fasteners are forced at spaced intervals into underlying shingles with each falling movement of said fastener means.

2. Apparatus of claim 1 wherein said framework is comprised of a pair of bent tubular members which converge in going from the rear to the front of said apparatus.

3. Apparatus of claim 1 wherein the front portion of said framework is shorter than the rear portion thereof.

4. Apparatus of claim 3 wherein said storage compartment is disposed at a downward angle going from the rear to front portion of said framework.

5. Apparatus of claim 1 wherein said automatic fastener means is a pneumatically activated stapler.

* * * * *